US005214353A

United States Patent [19]

Nilssen

[11] Patent Number: 5,214,353

[45] Date of Patent: May 25, 1993

[54] FLASHLIGHT WITH BOOST FEATURE

[76] Inventor: Ole K. Nilssen, Caesar Dr., Barrington, Ill. 60010

[21] Appl. No.: 832,948

[22] Filed: Feb. 10, 1992

Related U.S. Application Data

[63] Continuation-in-part of Ser. No. 652,378, Feb. 7, 1991, which is a continuation of Ser. No. 410,745, Sep. 22, 1989, abandoned.

[51] Int. Cl.[5] ..... H05B 37/00

[52] U.S. Cl. ..... 315/33; 315/129; 315/170; 315/176; 362/157

[58] Field of Search ..... 315/33, 51, 52, 53, 315/76, 129, 136, 170, 171, 172, 175, 176, 200 R, 224, 306, 362; 362/157, 202, 204, 205, 206

[56] References Cited

U.S. PATENT DOCUMENTS

| | | | |
|---|---|---|---|
| 4,499,525 | 2/1985 | Mallory | 315/307 X |
| 4,757,238 | 7/1988 | Rhee | 315/33 X |
| 5,027,035 | 6/1991 | McGrail et al. | 315/129 X |
| 5,107,180 | 4/1992 | Ormanns et al. | 315/33 X |

*Primary Examiner*—David Mis

[57] ABSTRACT

Connected in circuit between a regular two-cell battery and the light bulb in an otherwise ordinary flashlight is an auxiliary voltage source, such as a third battery cell of relatively small size. The bulb is normally powered directly from the regular two-cell battery. However, if a boost in light output is desired for a brief period of time, the auxiliary voltage source is connected in series with the two-cell battery. Switching is accomplished by way of a slide switch that has an OFF-position, an ON-position, and a spring-loaded BOOST-position. In the BOOST-position, the auxiliary voltage source is coupled in series with the two-cell battery, thereby boosting the RMS magnitude of the voltage applied to the light bulb by a factor of as much as 1.5; which, in turn, boosts the light output by a factor of about 4.0. To prevent substantial shortening of the overall life of the light bulb, since the life of the light bulb would be shortened by a substantial factor if being supplied with 1.5 times its normal voltage on a continuous basis, the boost feature should be used only on an occasional basis, such as for ten seconds at a time.

25 Claims, 4 Drawing Sheets

FLASHLIGHT WITH BOOST FEATURE

RELATED APPLICATIONS

Instant application is a continuation-in-part of Ser. No. 07/652,378 filed Feb. 7, 1991; which is a continuation of Ser. No. 07/410,745 filed Sep. 22, 1989, now abandoned.

BACKGROUND OF THE INVENTION

Field of the Invention

The present invention relates to flashlights and similar battery-powered light sources.

SUMMARY OF THE INVENTION

Objects of the Invention

An object of the present invention is the provision of cost-effective means whereby the light output from a battery-powered light source, such as a flashlight, might be boosted beyond what normally would be obtained.

This as well as other objects, features and advantages of the present invention will become apparent from the following description and claims.

Brief Description

Connected between a regular two-cell battery and the light bulb in an otherwise ordinary flashlight is an auxiliary voltage source, such as a third battery cell of relatively small size. In most situations when using the flashlight, the bulb is powered directly from the regular two-cell battery. However, if a boost in light output is desired for a brief period of time, the auxiliary voltage source is connected in series with the two-cell battery, thereby increasing the RMS magnitude of the voltage provided to the light bulb.

Switching is accomplished by way of a slide switch that has an OFF-position, an ON-position, and a spring-loaded BOOST-position. In the BOOST-position, the auxiliary voltage source is coupled in series with the two-cell battery, thereby boosting the RMS magnitude of the voltage applied to the light bulb by a factor of as much as 1.5; which, in turn, boosts the light output by a factor of about 4.0.

To prevent substantial shortening of the overall life of the light bulb, since the life of the light bulb would be shortened by a substantial factor if being supplied with 1.5 times its normal voltage on a continuous basis, the boost feature should be used only briefly on an occasional basis, such as for ten seconds at a time.

DESCRIPTION OF THE PREFERRED EMBODIMENT

Details of Construction of the Initial Embodiments

Figure 1:
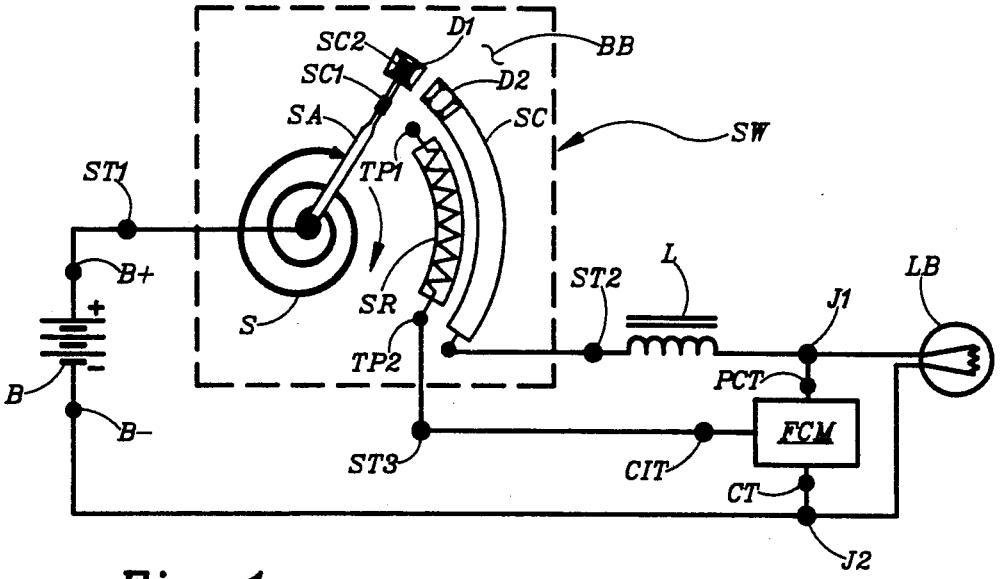
FIG. 1 schematically illustrates a first initial embodiment of the invention.

FIG. 1 schematically illustrates a first initial embodiment of the invention in the form of an electrical circuit diagram.

In FIG. 1, a battery B has a B+ terminal and a B− terminal. The B+ terminal is connected with a switch terminal ST1 of a slide switch SW; which switch terminal, in turn, is connected with a slideable arm SA of slide switch SW. Slideable arm SA is connected with a spring S, and has first and second slide contactors SC1 and SC2, as well as a slide conductor SC and a slide resistor SR. Slide conductor SC and slide resistor SR are both mounted on a back board BB; in which back board there is a first detent D1. Slide conductor SC, in which there is a second detent D2, is connected with a switch terminal ST2. Slide resistor SR has a first terminal point TP1 and a second terminal point TP2; which second terminal point is connected with a switch terminal ST3.

An energy-storing inductor L is connected between switch terminal ST2 and a first junction J1; and a light bulb LB is connected between first junction J1 and a second junction J2.

A forward converter means FCM has: (i) a common terminal CT, which is connected with second junction J2; (ii) a power control terminal PCT, which is connected with first junction J1; and (iii) a control input terminal CIT, which is connected with switch terminal ST3.

Figure 2:
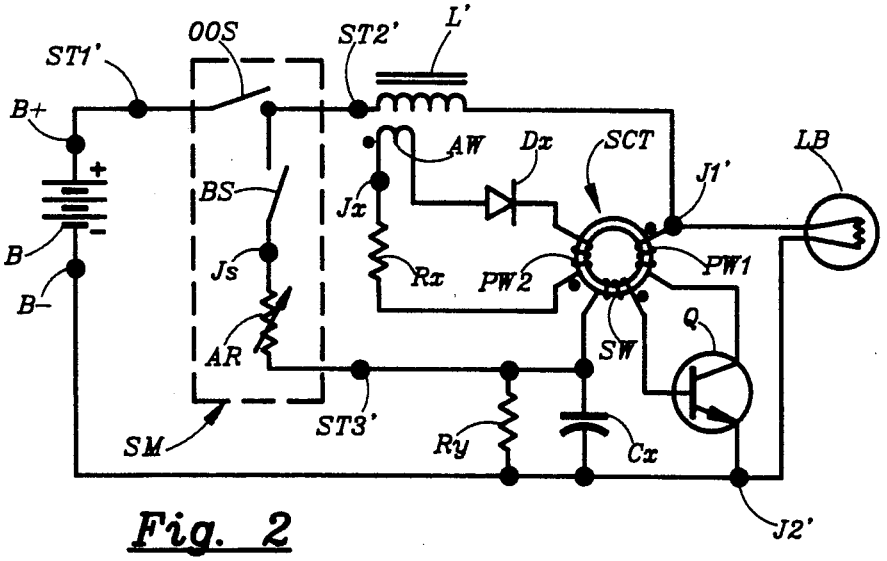
FIG. 2 diagrammatically illustrates a forward converter of a type suitable for use in the first initial embodiment.

FIG. 2 diagrammatically illustrates a forward converter of a type suitable for use in the arrangement of FIG. 1.

In FIG. 2, battery B and battery terminals B+ and B− are equivalent to the corresponding elements of FIG. 1. However, slide switch SW of FIG. 1 has been replaced with a switch means SM; which has a first switch terminal ST1', a second switch terminal ST2', and a third switch terminal ST3'. Within switch means SM is: (i) an ON-OFF switch OOS connected between switch terminals ST1' and ST2'; (ii) a BOOST switch BS connected between switch terminal ST2' and a junction Js; and (iii) an adjustable resistor AR connected between junction Js and switch terminal ST3'.

An energy-storing inductor L', corresponding to energy-storing inductor L of FIG. 1, is connected between switch terminal ST2' and a first junction J1'; which energy-storing inductor has an auxiliary winding AW, whose terminals are connected between the anode of diode Dx and a junction Jx.

A transistor Q is connected with its emitter to a second junction J2', and—by way of a first primary winding PW1 of a saturable current transformer SCT—is connected with its collecter to junction J1'. The base of transistor Q is connected with switch terminal ST3' by way of secondary winding SW of saturable current transformer SCT.

A resistor Rx is connected with the cathode of diode Dx by way of a second primary winding PW2 of saturable current transformer SCT. Another resistor Ry and a capacitor Cx are both connected between switch terminal ST3' and junction J2'.

Light bulb LB is connected between junctions J1' and J2'.

Figure 3:
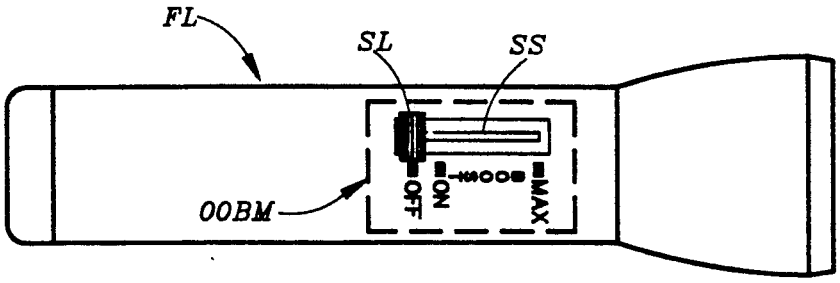
FIG. 3 illustrates a flashlight made in accordance with the first initial embodiment.

FIG. 3 illustrates a flashlight FL made in accordance with the invention.

In FIG. 3, an ON/OFF/BOOST control means OOBM—which corresponds to slide switch SW of FIG. 1—has a slide lever SL slideably movable in a slide slot SS between markings OFF, ON, BOOST and MAX.

Figure 5:
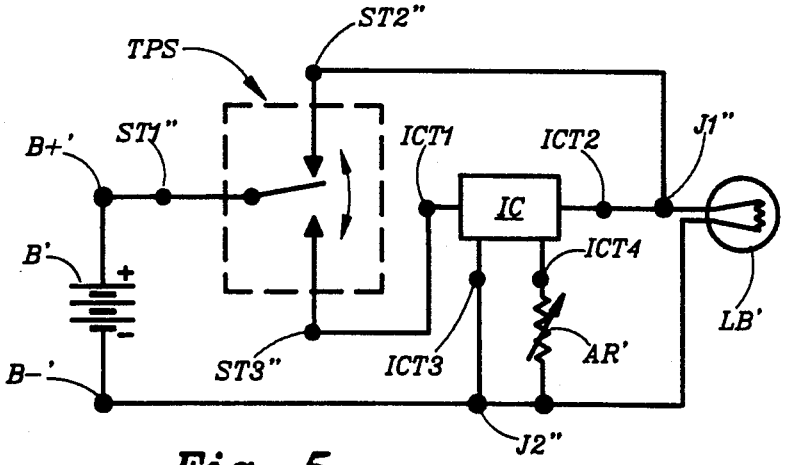
FIG. 5 schematically illustrates a second initial embodiment of the invention.

FIG. 5 schematically illustrates a second initial embodiment of the invention.

In FIG. 5, a battery B' has B+' and B−' terminals. A three-position switch TPS has: (i) a first switch terminal ST1", which is connected with the B+ terminal; (ii) a second switch terminal ST2", which is connected with a first junction J1"; and (iii) a third switch terminal ST3", which is connected with a first IC terminal ICT1 of an integrated circuit IC.

A second IC terminal ICT2 is connected with first junction J1". A third IC terminal ICT3 is connected with a second junction J2"; which is also connected with the B−' terminal. A fourth IC terminal ICT4 is connected with second junction J2" by way of an adjustable resistor AR'. A light bulb LB' is connected between junctions J1" and J2".

Explanation of Waveforms

Figure 4:
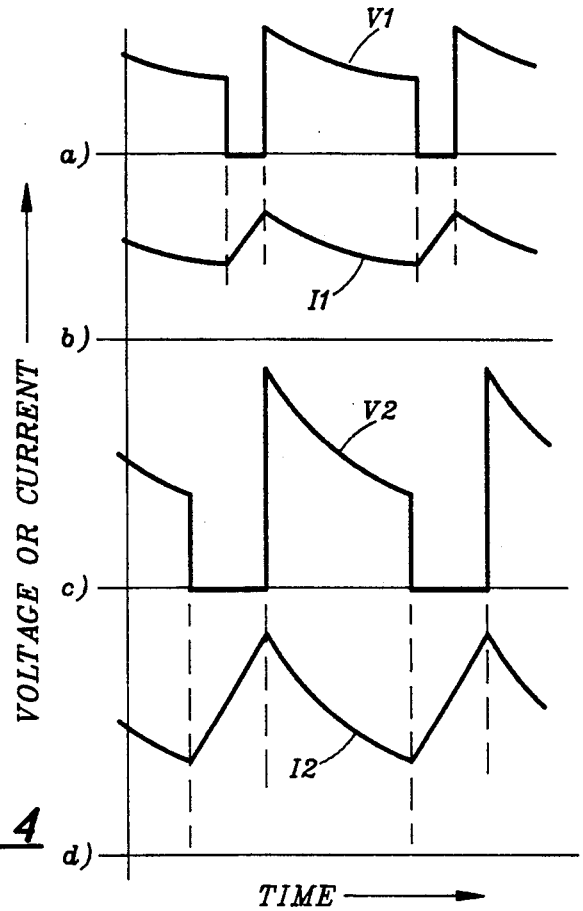
FIG. 4 shows some of the current and voltage waveforms associated with the first initial embodiment.

FIG. 4 shows some of the current and voltage waveforms associated with the arrangement of FIG. 1.

FIG. 4(*a*) shows the waveform of the voltage V1 provided across light bulb LB under a condition of providing a moderate amount of BOOST; while FIG. 4(*b*) shows the waveform of the corresponding current I1 flowing through inductor L.

FIG. 4(*c*) shows the waveform of the voltage V2 provided across light bulb LB under a condition of providing maximum amount of BOOST; while FIG. 4(*d*) shows the waveform of the corresponding current I1 flowing through inductor L.

Figure 6:
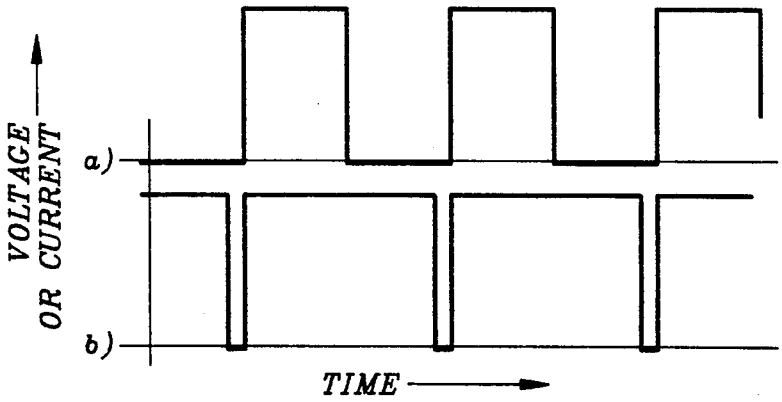
FIG. 6 shows some of the voltage waveforms associated with the second initial embodiment of the invention.

FIG. 6 shows some of the current and voltage waveforms associated with the arrangement of FIG. 5.

FIG. 6(*a*) shows the waveform of the voltage V1' provided across light bulb LB' under a condition of providing a moderate amount of BOOST; while FIG. 6(*b*) shows the waveform of the voltage V2' provided across light bulb LB' under the condition of providing the maximum amount of BOOST.

Details of Operation of the Initial Embodiments

In the arrangement of FIG. 1, with slideable arm SA in the position shown, battery B is disconnected and no power flows through light bulb LB. With slideable arm SA moved from its first (or OFF) detent D1 and into its second (or ON) detent D2, the full battery voltage gets applied to light bulb LB via slide conductor SC. However, connection is not yet made with slide resistor SR; and forward conversion means FCM constitutes an open circuit between terminals PCT and CT.

Moving slideable arm SA past its ON-detent causes connection to be made between the B+ terminal and slide resistor SR, thereby causing a control current to flow into control input terminals CIT. This control current will cause forward conversion means FCM to start operating such as to cause a short circuit to occur intermittently between junctions J1 and J2.

With reference to FIG. 4, forward conversion means FCM causes a relatively brief short circuit to occur periodically between junctions J1 and J2 (see FIG. 4*a* or 4*c*). During each such brief period of short circuit, the DC voltage of battery B is applied directly across energy-storing inductor L; which means that whatever current was flowing through that inductor just prior to the onset of the short circuit will increase rapidly (see FIG. 4*b* or 4*d*). At the end of each brief period of short circuit, the by-now larger-magnitude inductor current will be switched to flow through light bulb LB. Thereafter, its magnitude will decay in an exponential manner toward the level determined by the ratio of the magnitude of the DC voltage and the magnitude of the resistance of the light bulb.

As a result, the RMS magnitude of the voltage V1 resulting across the light bulb will be larger that it was without the action of the forward conversion means. That is, the reduction in RMS magnitude resulting from the periodic brief short circuits is more than compensated-for by the increase in RMS magnitude resulting from the extra energy imparted to the energy-storing inductor during the periods when the short circuit is present and released during the periods when the short circuit is not present.

Without the action of the forward converter means, the current flowing from the battery would simply be at the level indicated by the minimum points of waveform I1. As a result of the action of the forward converter means, the average magnitude of the current drawn from the battery increases; which increased flow of current simply translates into increased power drawn from the battery; which increased power has no other place to go but into the light bulb.

By varying the duration of the short circuit period, the amount of power applied to the light bulb will vary correspondingly. FIG. 4*c* indicates a situation where the RMS magnitude of the voltage applied across the light bulb has been increased by about 50%.

Forward conversion means FCM may be made in many different ways. For instance, it could be made in the form of a custom integrated circuit expressly designed to perform the function herein specified. Or, it could be made in the manner illustrated by FIG. 2; which shows a self-oscillating single transistor oscillator.

In the circuit of FIG. 2, when switches OOS and BS are both closed, current flows through adjustable resistor AR, thereby to charge capacitor Cx.

Eventually, the voltage on Cx reaches a magnitude high enough to cause transistor Q to become conductive, at which point current will start flowing into the collector of transistor Q and thereby through primary winding PW1 of saturable current transformer SCT as well. In turn, this flow of collector current will cause additional base current to be provided to the base of transistor Q; and, by means of positive feedback, transistor Q now becomes fully conductive: sufficiently so to constitute an effective short circuit between junctions J1 and J2.

After a brief period of time, such as about 10 microseconds, saturable current transformer SCT saturates, thereby stopping the flow of base current; which therefore causes transistor Q to stop conducting. Now, the increased inductor current will flow into the light bulb; and, as a result, a voltage is induced across auxiliary winding AW; which voltage, by way of diode Dx and secondary winding PW2, is used for resetting saturable current transformer SCT, thereby to make it ready for a new cycle.

While secondary winding SW provided base current for transistor Q, this base current actually flowed out of capacitor Cx and therefore caused the voltage at terminal ST3' to become quite negative; which, as long as this negative voltage does indeed exist, prevents transistor Q from entering another cycle of positive-feedback-maintained conduction. However, current flowing through adjustable resistor AR will gradually cause the voltage at terminal ST3' again to become positive and to cause transistor Q to start conducting; whereafter transistor Q, with the help of saturable current transformer SCT, will initiate another positive-feedback-maintained period of conduction.

The lower be the magnitude of the resistance of adjustable resistor AR, the shorter be the time it takes for the negative voltage at terminal ST3' to be dissipated; and the shorter become the duration of the periods of transistor non-conduction versus the duration of the periods of transistor conduction.

For additional information with respect to the operation of single-ended self-oscillating transistor oscillators, reference is made to U.S. Pat. Re. No. 32,155 to Ole Nilssen.

With respect to the operation of flashlight FL of FIG. 3, it is sufficient to mention that the light output from this flashlight is controlled as follows.

With slide lever SL in the OFF-position, no light is provided. With the slide lever in the ON-position, an ordinary amount of light is provided.

Both the OFF-position and the ON-position are detented.

Pushing slide lever SL past the detented ON-position, light output increases in approximate proportion to the degree to which the slide lever is pushed past the ON-position. When the slide lever is pushed all the way to the indicated MAX-position, the light output will be about four times higher than it is in the normal-output ON-position.

The slide lever is spring-loaded in such manner that, when pushed past the ON-position and without expressly holding it there, it will automatically return to the detented ON-position.

Whereas the arrangement of FIG. 1 is intended for a situation where the light bulb is designed to operate in its normal mode of light output, as well as to have an ordinary life expectancy, when powered with the full voltage available from the battery; the arrangement of FIG. 5 is intended for a situation where the light bulb is designed to have an unusually high level of light output, as well as an unusually short life expectancy, when powered with the full voltage of the battery.

Thus, while the task of forward conversion means FCM of FIG. 1 is that of increasing the RMS magnitude of the voltage applied to the light bulb, thereby to get increased light output in exchange for reduced bulb life expectancy; the task of integrated circuit IC of FIG. 5 is that of decreasing the RMS magnitude of the voltage applied to the light bulb, thereby to get increased bulb life expectancy in exchange for reduced light output.

Thus, in the arrangement of FIG. 5, operating the light bulb so as to attain an ordinary level of light output in combination with an ordinary life expectancy, requires a reduction of the RMS magnitude of the voltage available directly from the battery. By way of integrated circuit IC, this reduction in RMS magnitude is simply attained by connecting/disconnecting the light bulb from the battery in a rapid periodic manner, thereby to reduce the RMS magnitude of the voltage applied to the light bulb in proportion to the square root of the duty cycle. That is, compared with a 100% or unity duty cycle (where the light bulb is continuously connected with the battery) a 50% of 0.5 duty cycle (where the light bulb is connected with the battery only 50% of the time) gives rise to a reduction of RMS magnitude by a factor equal to the square root of 0.5, or equal 0.7.

While the arrangement of FIG. 1 requires an energy-storing inductor in order to attain a voltage magnitude boost; the arrangement of FIG. 5 does not require such an energy-storing means since it does not need to attain a voltage magnitude boost.

The function of the circuit of FIG. 5 is illustrated by the voltage waveforms of FIG. 6.

The voltage waveform of FIG. 6*b* indicates a situation of near maximum BOOST; where the full battery voltage is applied to the light bulb with nearly 100% duty cycle. The voltage waveform of FIG. 6*a* indicates a situation where the full battery voltage is applied to the light bulb with less than 50% duty cycle, such as to cause the RMS magnitude of the voltage applied to the light bulb to be only about two thirds of the full battery voltage, thereby providing for about one fourth the light output and 200 times longer life expectancy as compared with providing the light bulb with the full battery voltage.

Additional Comments re Initial Embodiments (a) The arrangement of FIG. 1 corresponds to a situation of merely adding the indicated electronic circuitry to an otherwise ordinary flashlight having a common (ex: 3 Volt, two-cell) battery and a matching ordinary (ex: 3 Volt, 50 hour) light bulb.

(b) The arrangement of FIG. 5 corresponds to a situation of either: (i) using an ordinary-voltage (ex: 3 Volt, two-cell) battery in combination with a lower-voltage (ex: 2 Volt, 50 hour) light bulb; or (ii) using a higher-voltage (ex: 4.5 Volt, three-cell) battery in combination with an ordinary-voltage (ex: 3 Volt, 50 hour) light bulb; or (iii) using an ordinary-voltage (ex: 3 Volt, two-cell) battery in combination with a matching short-life/high-efficacy (ex: 15 minutes life) light bulb; etc.

(c) It is important to realize that in incandescent lamps, such as ordinary light bulbs for flashlights, there is a clear and consistent relationship between luminous efficacy and lamp life. By increasing the RMS magnitude of the voltage applied to a given lamp, the lamp's luminous efficacy increases while its life expectancy decreases. Conversely, by reducing the RMS magnitude of the voltage applied to the lamp, the lamp's luminous efficacy decreases while its life expectancy increases.

(d) Clearly, in the arrangement of FIG. 5, instead of reducing the RMS magnitude provided to the light bulb by way of duty-cycling the connection between the light bulb and the battery, a variable resistor means could be used for attaining such a reduction. However, efficiency (and thereby battery life) would then be severely compromised.

(e) In light of instant disclosure, it is clear that the BOOST feature may be also be attained—although only in a non-variable manner—either: (i) by powering a given light bulb with a two-cell battery and then, to attain a fixed-level BOOST, to switch-in an auxiliary cell such as to increase the RMS magnitude of the voltage applied to the light bulb; or (ii) by connecting to a given battery either one or the other of two light bulbs: one designed for normal operation on the voltage from the given battery, the other designed to provide high-efficacy/short-life operation on that same voltage.

Also, the effect of two light bulbs could be attained by using a light bulb with two filaments.

(f) Just as is the case with forward conversion means FCM of FIG. 1, integrated circuit IC of FIG. 5 may—in the form of a custom integrated circuit made to function in accordance with the functional specifications provided herein—readily and routinely be obtained from a semiconductor manufacturer.

(g) The basic BOOST feature herein disclosed is applicable to various types of battery-powered lighting means, including those wherein the light output is provided by gas discharge lamps.

(h) Clearly, the BOOST feature is basically intended to be used for only a small percentage of the total usage time of a flashlight. Normally, a flashlight with the BOOST feature would have a light bulb that would have a life expectancy of about 50 hours if used continuously in the ON-position and about 15 minutes if used continuously in the MAX BOOST position.

In actual usage, it is expected that the flashlight will be used in the plain ON-position most of the time, and in the MAX-BOOST-position for only a small fraction of the time. What is important to understand is that each minute of usage on the MAX-BOOST-position is equivalent—as far as wear of the light bulb is concerned—to over three hours of usage in the plain ON-position. However, due partly to the much increased luminous efficacy associated with the MAX-BOOST-position, battery life will be much less affected by use of the MAX-BOOST-position: continuous operation in the MAX-BOOST-position would only shorten battery life by a factor of two or so; yet, the total net resulting light output (in Lumen-hours) attained from the battery would have doubled.

(i) The word "lamp" is herein defined to include various forms and types of incandescent light bulbs (ex: light bulbs for battery-powered hand-held flashlights) as well as gas discharge lamps (ex: fluorescent lamps for camper lanterns).

(j) In light of the invention represented by the initial embodiments, is it clear that the circuit arrangement illustrated by FIGS. 5 and 6 can be used for light DIMMING as well as for light BOOSTING. That is, it would readily be feasible to power the light bulb (in an adjustable manner) at less than the normal amount of power, thereby attaining longer than normal lamp life expectancy.

Also, while provisions are made for spring-loaded automatic return to regular ON-position after having used the BOOST-position, a similar automatic return from a DIM-position would not be necessary. Hence, in some lighting products it would be anticipated that the light control function include a detented OFF-position, a continuous DIMMING-range, a detented ON-position, an automatic-return BOOSTING-range, and an automatic-return MAX-BOOST-position.

(k) Also, by slight modification of the circuit arrangement of FIG. 5, mechanical switch means (such as TPS) may be entirely eliminated. Instead, integrated circuit IC may be made in such manner as to provide for all the required switching functions, for instance by way of a simple high-resistance potentiometer; which would provide both for the ON/OFF function as well as for the continuous-range DIMMING/BOOSTING function.

(l) By using a simple photo-sensor to sense the luminous output from the light bulb, and to feed the output from this photo-sensor back to integrated circuit IC, it is simple to provide for automatic control of luminous output, thereby to compensate for reduced battery output voltage with wear as well as for diminished luminous efficacy as the light bulb ages.

Of course, any changes in battery voltage can be automatically compensated-for merely by so specifying the IC.

(m) It is anticipated that it be desirable in some cases to filter the current provided to the light bulb, thereby to avoid possible mechanical resonances in the filament due to the high frequency content of the chopped voltage. In the arrangement of FIG. 5, this filtering would not need to consist of more than a filter capacitor connected in parallel with the light bulb and a filter inductor connected in series with the parallel-combination of the light bulb and the filter capacitor.

Details of Construction of the Preferred Embodiments

Figure 7:
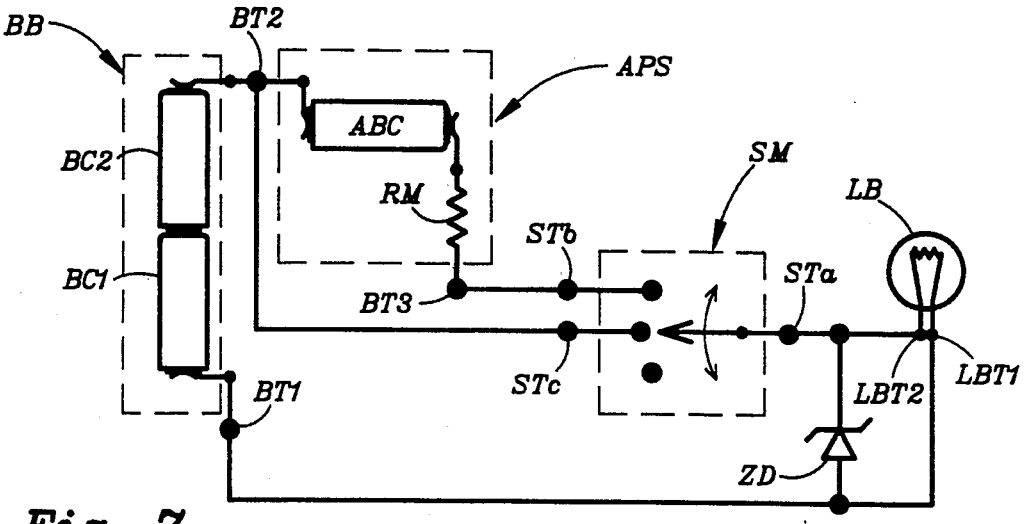
FIG. 7 schematically illustrates a first preferred embodiment of the invention.

FIG. 7 illustrates a first preferred embodiment of the present invention.

In FIG. 7, a first 1.5 Volt battery cell BC1 is series-connected with a second 1.5 Volt battery cell BC2 to form a basic battery BB having a first battery terminal BT1 and a second battery terminal BT2. An auxiliary battery cell ABC is series-connected with a resistor means RM to form an auxiliary power supply APS; which auxiliary power supply APS is connected between battery terminal BT2 and a battery terminal BT3.

Light bulb LB has a first light bulb terminal LBT1 connected with battery terminal BT1 and a second light bulb terminal LBT2 connected with a switch terminal STa of a three-position switch means SM; which switch means SM has a switch terminal STb connected with battery terminal BT3 and a switch terminal STc connected with battery terminal BT2.

A zener diode ZD is connected across light bulb terminals LBT1 and LBT2.

Figure 8:
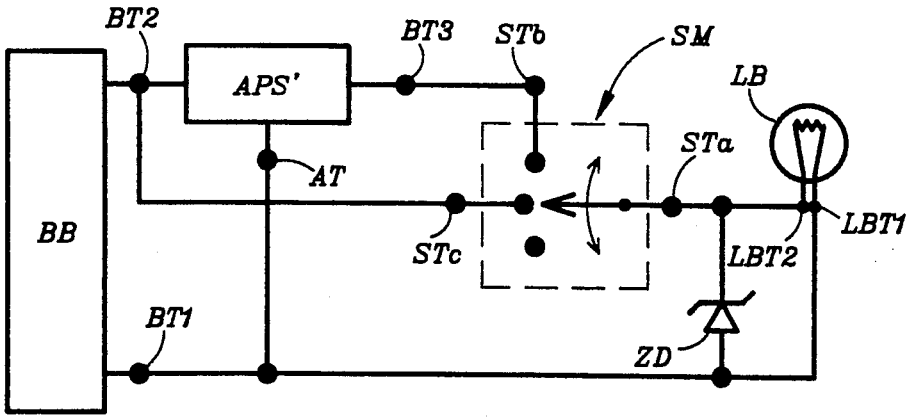
FIG. 8 schematically illustrates a second preferred embodiment of the invention.

FIG. 8 illustrates a second preferred embodiment of the present invention.

The arrangement of FIG. 8 is the same as that of FIG. 7 except for having an auxiliary power supply APS' instead of auxiliary power supply APS; which auxiliary power supply APS' has an auxiliary terminal AT connected with battery terminal BT1.

Figure 9:
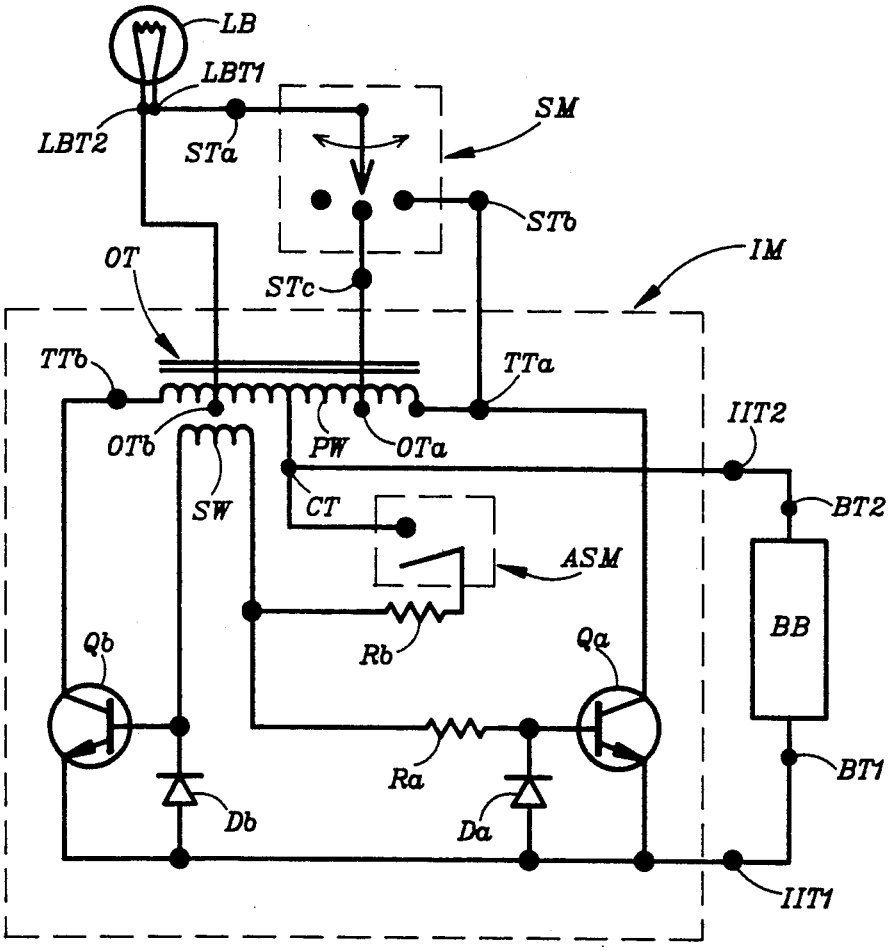
FIG. 9 schematically illustrates a third preferred embodiment of the invention.

FIG. 9 illustrates a third preferred embodiment of the present invention.

In FIG. 9, an inverter means IM has a first inverter input terminal IIT1 connected with first battery terminal BT1 of basic battery BB, as well as a second inverter input terminal IIT2 connected with second battery terminal BT2 of basic battery BB.

Inverter means IM includes a first transistor Qa and a second transistor Qb, each connected with its emitter to inverter input terminal IIT1. A first diode Da is connected between the base and the emitter of first transistor Qa; and a second diode Db is conected between the base and the emitter of second transistor Qb.

An output transformer OT has a primary winding PW which has transformer terminals TTa and TTb connected, respectively, with the collectors of transistors Qa and Qb. Primary winding PW also has: (i) a center tap CT, which is connected with inverter input terminal IIT2, (ii) an output terminal OTa, which is connected with switch terminal STc, and (iii) output terminal OTb connected with light bulb terminal LBT2. Transformer terminal TTa is also connected with switch terminal STb.

Output transformer OT also has a secondary winding SW, which is connected by way of a resistor Ra between the bases of transistors Qa and Qb.

A resistor Rb is, by way of an additional switch ASM, connected between one of the terminals of secondary winding SW and center-tap CT.

The combination of light bulb LB and switch means SM is connected with terminals OTb, OTa and TTa.

Details of Operation of the Preferred Embodiments

The operation of the first preferred embodiment of FIG. 7 may be explained as follows.

When switch means SM is in its regular ON-position, which is the particular position actually shown in FIG. 7, the voltage from basic battery BB is applied directly across light bulb terminals LBT1 and LBT2—just as in an ordinary flashlight.

However, when switch means SM is in the BOOST-position, which it is whenever it causes connection between switch terminal STa and switch terminal STb, the voltage provided to light bulb LB becomes: the voltage of basic battery BB, plus the voltage of auxiliary battery cell ABC, less any voltage-drop across resistor means RM (which resistor means RM may simply be nothing more than the internal resistance of auxiliary battery cell ABC).

Thus, long as the resistance of resistance means Rm is relatively small, the RMS magnitude of the voltage applied across the light bulb in the BOOST-position will be substantially larger than it is in the regular ON-position. How much larger depends on the magnitude of the resistance of resistance means RM and the Zenering-voltage of Zener diode ZD.

In an actual preferred arrangement: each of battery cells BC1 and BC2 of basic battery BB is an ordinary so-called D-cell; auxiliary battery cell ABC is an ordinary so-called AA-cell; light bulb LB is an ordinary light bulb for a two-cell flashlight and has a nominal operating voltage of 2.4 Volt; the resistance of resistor means RM is about 0.5 Ohm; and the Zenering voltage of Zener diode ZD is about 3.6 Volt.

With fresh battery cells, the total battery voltage in the BOOST-position is about 4.5 Volt. However, due to the Zener diode, the magnitude of the voltage applied across the terminals of light bulb LB is limited to about 3.6 Volt; at which voltage level light bulb LB will yield about four times its normal light output. The difference between the 4.5 Volt battery voltage and the 3.6 Volt Zener voltage is dropped across the internal resistances of each of the three battery cells combined with the 0.5 Ohm resistance of resistance means RM. The amount of current flowing through the Zener diode depends on the magnitude of the current flowing through the light bulb at an applied voltage of 3.6 Volt combined with the total resistance represented by the internal resistances of the three battery cells and that of resistance means RM.

The magnitude of the resistance of resistance means RM is mainly chosen such as not to overload the Zener diode during the brief initial period when the battery cells are fresh and capable of providing a much higher output voltage/current than they are capable of after having been used for just a small fraction of their total normal life span.

The Zenering voltage of Zener diode ZD is chosen such as to provide the maximum amount of light output commensurate with the shortest acceptable lamp operating life.

The arrangement of FIG. 8 operates in the same manner as that of FIG. 7 except for having a modified auxiliary power supply referred-to as APS'; which modified auxiliary power supply APS'—instead of including a third battery cell—includes an inverter means operative to draw DC power from the basic battery (BB) and to convert it to a high-frequency AC voltage; which high-frequency AC voltage is provided (e.g., by way of a secondary winding of a high-frequency transformer) between terminals BT2 and BT3. Thus, in the BOOST-position, the DC voltage from basic battery BB is additively augmented with an AC voltage provided by auxiliary power supply APS'; which means that, in the BOOST-mode, the RMS magnitude of the voltage provided across the light bulb termimals (LBT1/LBT2) is the quadratic sum of the RMS magnitude of the DC voltage and that of the AC voltage. With the DC voltage having an RMS magnitude of (say) 2.4 Volt and the AC voltage having an RMS magnitude of (say) 2.4 Volt (such as via a squarewave voltage having a peak magnitude of 2.4 Volt), the resulting RMS magnitude of the voltage presented to the light bulb terminals will be 2.4 Volt multiplied by the square root of two, or about 3.4 Volt.

The arrangement of FIG. 9 powers the light bulb with a high-frequency AC voltage both in the regular ON-position as well as in the BOOST-position. This high-frequency AC voltage is generated by way of a conventional self-oscillating push-pull inverter means that is powered from the basic battery (BB).

One additional advantage associated with the embodiment of FIG. 9 is that the voltage applied to the light bulb is a pure alternating voltage, having no DC component. When powered from such a pure AC voltage, as contrasted with being powered from a pure DC voltage, the light bulb will have a substantially longer service life for a given power level or light output.

Additional Comments re Preferred Embodiments (n) In the arrangement of FIG. 7, by choosing just the right combination of battery cells, the resistance value of resistance means RM can be made to be zero. For instance, with a basic battery (BB) consisting of two alkaline D-cells, by making the auxiliary battery cell (ABC) an alkaline N-cell, the resistance value of the resistance means may indeed be zero.

(o) The auxiliary battery cell may be of a rechargeable type (such as a Ni-Cad cell) charged from the basic battery via either a resistor means or a tiny inverter means.

(p) Since the BOOST-mode will necessarily (due to the very short life span of the light bulb during that mode) be used for only a small percentage of the total usage time of the flashlight, the energy capacity of the auxiliary battery cell need be only a small fraction of that of the basic battery. Thus, for most expected usage situations, an N-cell would have sufficient energy to provide useful BOOST-function in a case where the basic battery consists of two D-cells.

(q) The arrangement of FIG. 9, in addition to providing longer lamp life due to AC operation, provides for complete flexibility with respect to choice of lamp operating voltage. In particular, the arrangement of FIG. 9 permits the light bulb to be designed to have an operating voltage of RMS magnitude totally different from that of the basic battery (BB); which implies that the lamp operating voltage can be chosen for optimum lamp operating characteristics as opposed to having to be matched to the voltage provided directly from a given flashlight battery.

That is, in a two-cell flashlight, rather than to be limited to using a light bulb with nominal 2.4 Volt operating voltage (as is presently the case), a light bulb with, say, nominal 6.0 Volt operating voltage may be used.

For a given lamp life expectancy and at the power levels usually associated with two-cell flashlights, a light bulb designed for a 2.4 Volt nominal operating voltage does not provide maximum luminous efficacy. Rather, a design voltage other than 2.4 Volt would provide for maximum luminous efficacy.

(r) As with any incandescent lamp, the filament of an incandescent light bulb of the type used in flashlights has a life expectancy that is a sensitive function of the RMS magnitude of the voltage applied to the filament. If the voltage applied to the filament is increased in RMS magnitude by one half over its nominal value, the life expectancy of that filament will be decreased by a factor of about 200; and, if the applied voltage were to be decreased by one third, the life expectancy of that filament would be increased by a factor of about 200. In the former case, the light output would be increased by a factor of about four; in the latter case the light output would be decreased by a factor of about four.

That is, when operating with increased RMS magnitude, rate of filament wear increases, and vice versa. In particular, whenever operating the filament with a 50%-above-nominal RMS voltage, the filament gets consumed at a rate that is about 200 times higher than when operated at nominal RMS voltage.

For instance, whenever operating the light bulb in a flashlight in the BOOST-mode in accordance with the arrangement of FIG. 7, the filament in that light bulb will wear at a rate about 200 times faster than when the filament is operated without using the BOOST-feature. Typically, in a BOOST-mode yielding four times nominal light output, the filament will wear at a rate of about 400% per hour versus a nominal rate of about 2% per hour.

(s) In the arrangement of FIG. 7, the Zener diode (ZD) may be substituted or augmented with a light-emitting diode (LED), thereby to attain additional functional values.

For instance, when substituting for the Zener diode, the light-emitting diode will serve the dual purpose of limiting the magnitude of the voltage applied to the light bulb as well as providing a visual indication of the RMS magnitude of the applied voltage.

In particular, it is anticipated that an LED of green color be used instead of the Zener diode. However, to provide for the proper level of limiting/indicating voltage, one or more diode junctions should be used in series with the LED.

Otherwise, one or more LED's may be used in parallel with the Zener diode: a green LED (if necessary, with built-in diode junctions to result in the desired voltage limiting level) for indicating that the voltage applied to the lamp is of sufficient magnitude to provide full BOOST; an yellow LED (with its proper voltage-dropping junctions) to indicate that the voltage applied to the lamp is sufficient to provide full nominal light output; and a red LED (with a current-limiting resistor in series) to indicate that the applied voltage is of insufficient magnitude to provide nominal light output.

(t) It is believed that the present invention and its several attendant advantages and features will be understood from the preceeding description. However, without departing from the spirit of the invention, changes may be made in its form and in the construction and/or interrelationships of its component parts, the form herein presented merely representing the currently preferred embodiment.

What is claimed is:

1. A flashlight comprising:

first battery means having a first pair of battery terminals across which there exists a first battery voltage;

second battery means having a second pair of battery terminals across which there exists a second battery voltage;

light bulb means having a pair of lamp terminals; and switch means connected in circuit between the battery terminals and the lamp terminals; the switch means being operable to cause a lamp voltage to be provided across the lamp terminals; the lamp voltage having a magnitude being: (i) in a first mode, equal to that of the first battery voltage, or (ii) in a second mode, equal to the sum of the magnitudes of the first battery voltage and the second battery voltage; the switch means permitting a user of the flashlight to select between the two modes; the magnitude of the first battery voltage being substantially different from that of the second battery voltage.

2. The flashlight of claim 1 wherein: (i) the first battery means includes a battery cell of a first energy output capacity; (ii) the second battery means includes a battery cell of a second energy output capacity; and (iii) the first energy output capacity is substantially higher than the second energy output capacity.

3. The flashlight of claim 1 wherein: (i) the first battery means includes a first number of battery cells; (ii) the second battery means includes a second number of battery cells; and (iii) the first number is larger than the second number.

4. The flashlight of claim 3 wherein: (i) the first battery means includes two battery cells; and (ii) the second battery means includes only one battery cell.

5. The flashlight of claim 1 wherein: (i) in the first mode, the light bulb means emits a first level of luminous flux; (ii) in the second mode, the light bulb means emits a second level of luminous flux; and (iii) the second level of luminous flux is substantially higher than the first level of luminous flux.

6. The flashlight of claim 1 wherein: (i) the light bulb means has a nominal RMS operating voltage; and (ii) in the second mode, the RMS magnitude of the lamp voltage actually provided to the light bulb means at its lamp terminals is substantially higher than the nominal RMS operating voltage.

7. The flashlight of claim 1 wherein the light bulb means has a nominal RMS operating voltage under 6.8 Volt.

8. The flashlight of claim 1 wherein the light bulb means includes an incandescent lamp.

9. The flashlight of claim 1 wherein: (i) the first battery voltage has an RMS magnitude no higher than 4.5 Volt; and (ii) the second battery voltage has an RMS magnitude no higher than 3.8 Volt.

10. A flashlight characterized by comprising:

a first pair of output terminals across which there exists a first output voltage;

a second pair of output terminals across which there exists a second output voltage;

an incandescent light bulb having a pair of lamp terminals; and switch means connected in circuit between the pairs of output terminals and the lamp terminals; the switch means being operable to cause a lamp voltage to be provided across the lamp terminals; the lamp voltage having a magnitude: (i) in a first mode, equal to that of the first output voltage, or (ii) in a second mode, equal to the sum of the magnitudes of the first output voltage and the second output voltage; the magnitude of the first output voltage being substantially different from that of the second output voltage; the switch means permitting a user of the flashlight to select between the two modes.

11. The flashlight of claim 10 wherein the second output voltage is an AC voltage.

12. The flashlight of claim 11 wherein the first output voltage is also an AC voltage.

13. The flashlight of claim 10 additionally characterized by comprising: (i) battery means; and (ii) inverter means connected in circuit between the battery means and the output terminals.

14. A flashlight comprising:

a first battery means having a first pair of battery terminals across which exists a first battery voltage;

lamp means having a pair of lamp terminals; and control means connected in circuit between the first pair of battery terminals and the lamp terminals; the control means being operative to cause a unidirectional voltage to be applied across the lamp terminals; the RMS magnitude of this unidirectional voltage being larger than that of the first battery voltage; the control means being characterized by including an energy source having a pair of source terminals across which exists a source voltage having a magnitude substantially different from that of the first battery voltage.

15. The flashlight of claim 14 wherein the control means includes a second battery means.

16. The flashlight of claim 15 wherein: (i) the first battery means is characterized by being of a first weight; (ii) the second battery means is characterized by being of a second weight; and (iii) the first weight is substantially larger than the second weight.

17. The flashlight of claim 15 wherein: (i) the first battery means is characterized by being of a first physical size; (ii) the second battery means is characterized by being of a second physical size; and (iii) the first size is substantially larger than the second size.

18. The flashlight of claim 14 wherein the lamp means includes an incandescent light bulb.

19. A flashlight comprising:

incandescent lamp means having a nominal lamp operating voltage;

a first battery means operative to provide a first battery voltage; and control means connected in circuit between the incandescent lamp means and the first battery means; the control means being operative: (i) in a first mode, to apply a first operating voltage to the lamp means, and (ii) in an alternative second mode, to provide a second operating voltage to the lamp means; the RMS magnitude of the first lamp operating voltage being substantially equal to that of the first battery voltage as well as to that of the nominal lamp operating voltage; the RMS magnitude of the second operating voltage being substantially higher than that of the nominal lamp operating voltage.

20. A flashlight comprising:

battery means operative to provide a battery voltage at a pair of battery terminals; the battery voltage being of: (i) a higher magnitude whenever no current flows from the battery terminals; and (ii) a lower magnitude whenever current does flow from the battery terminals;

lamp means having a nominal lamp operating voltage; the lamp means having a pair of lamp terminals;

power-absorbing voltage-limiting means connected across the lamp terminals and operative to prevent the magnitude of any voltage present across the lamp terminals from exceeding a predetermined magnitude; and switch means connected in circuit between the battery terminals and the lamp terminals; the switch means being operable, in response to a command action, to provide electrical connection between the battery terminals and the lamp terminals.

21. The flashlight of claim 20 wherein the voltage-limiting means includes a light-emitting diode.

22. The flashlight of claim 20 wherein the voltage-limiting means includes a light-emitting diode.

23. The flashlight of claim 20 wherein the predetermined magnitude is lower than the higher magnitude.

24. The flashlight of claim 20 wherein the predetermined magnitude is substantially higher than the magnitude of the nominal lamp operating voltage.

25. A flashlight comprising:

battery means operative to provide a battery voltage at a pair of battery terminals;

lamp means having a nominal lamp operating voltage; the lamp means having a pair of lamp terminals;

indicator means having a pair of indicator terminals and operative to provide a visually discernible indication whenever the magnitude of any voltage present across the indicator terminals exceeds a predetermined level; and switch means connected in circuit between the battery terminals, the lamp terminals, and the indicator terminals; the switch means being operable, in response to a command action, to provide electrical connection between the battery terminals and the lamp terminals and/or the indicator terminals.

* * * * *